United States Patent [19]

Koch

[11] 4,297,546

[45] Oct. 27, 1981

[54] ACTUATING MEANS FOR SWITCH OPERATION IN TIMING APPARATUS

[75] Inventor: Claude V. Koch, Two Rivers, Wis.

[73] Assignee: AMF Incorporated, White Plains, N.Y.

[21] Appl. No.: 140,357

[22] Filed: Apr. 14, 1980

[51] Int. Cl.[3] ..... H01H 43/10

[52] U.S. Cl. ..... 200/38 R; 200/38 FB; 200/38 D; 200/38 DA

[58] Field of Search ..... 200/38 R, 38 A, 38 FA, 200/38 FB, 38 B, 38 BA, 38 C, 38 CA, 38 D, 38 DC; 74/568 R, 568 T, 568 M

[56] References Cited

U.S. PATENT DOCUMENTS

| | | | |
|---|---|---|---|
| 2,596,330 | 5/1952 | Everand | 200/38 DB |
| 3,454,730 | 7/1969 | Miller | 200/38 R |
| 3,588,391 | 6/1971 | Banathy et al. | 200/38 A X |
| 3,728,500 | 4/1973 | Ingram | 200/38 FB |
| 3,925,629 | 12/1975 | Albinger, Jr. | 200/38 DA X |
| 3,997,742 | 12/1976 | Marquis | 200/38 D X |
| 4,123,628 | 10/1978 | Kern et al. | 200/38 D |
| 4,171,471 | 10/1979 | Boyles | 200/38 D |

*Primary Examiner*—James R. Scott

*Attorney, Agent, or Firm*—George W. Price; Lawrence Hager

[57] ABSTRACT

Switch actuating mechanism for use in a timing device. The mechanism is simple, easy to manufacture, and is reliable in operation. The mechanism is selectively adjustable to maintain the switch continuously ON, continuously OFF, or ON and OFF in response to time setting pins on a rotating time dial.

11 Claims, 15 Drawing Figures

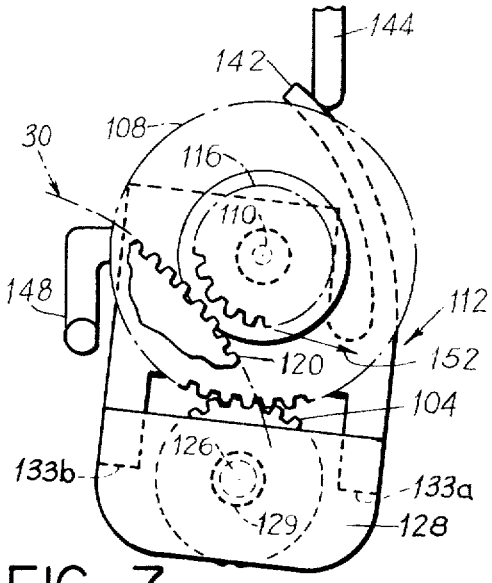
FIG. 7
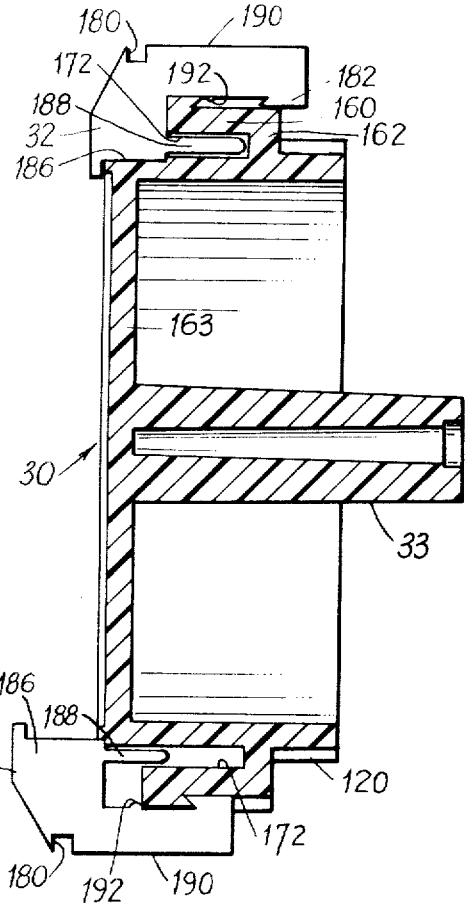
FIG. 8
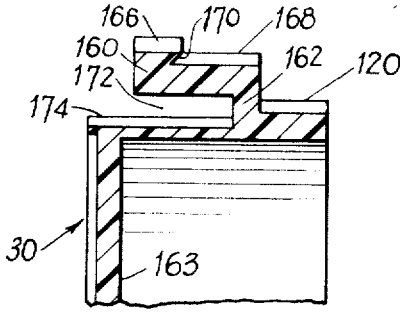
FIG. 9
FIG. 10
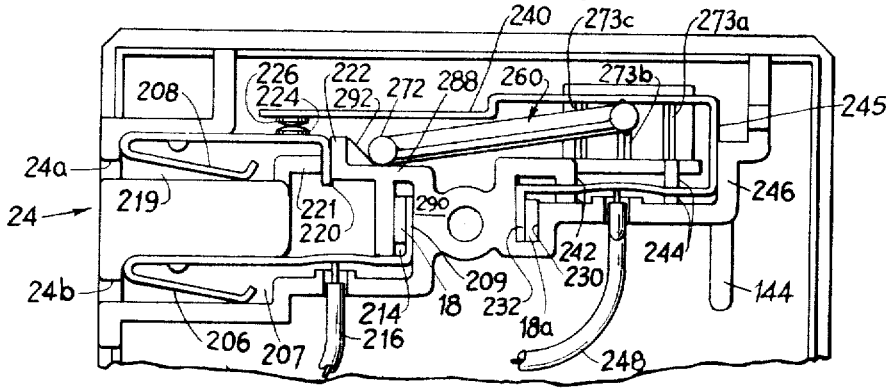

ACTUATING MEANS FOR SWITCH OPERATION IN TIMING APPARATUS

RELATED APPLICATION

This application is related to a concurrently filed application Ser. No. 141,444 filed Apr. 18, 1980 entitled Timing Apparatus for Lamps and Appliances, by Roger D. Rulseh.

This invention relates to a mechanism for controlling the electrical switching operation in a timing apparatus that may be used to control the ON-OFF operation of household lamps and appliances. The apparatus plugs into an electrical receptacle commonly provided in the wall of a residence or office. The apparatus includes in its molded plastic case a female receptacle into which the plug of a lamp or appliance is inserted. Timer operated switching means of this invention is located within the case and controls the connection of the female receptacle, and thus the lamp or appliance, to the source of electrical power that energizes the wall receptacle.

BRIEF DESCRIPTION OF DRAWINGS

FIG. 7 is a view similar to FIG. 5 that is used in explaining the operation of the apparatus of FIG. 5;

FIGS. 8 and 9 are sectional views of the time setting dial, with and without the setting pins that are shown on the front of the apparatus illustrated in FIG. 1;

FIG. 10 is a plan view showing only the internal portion of the apparatus that contains the electrical switching and electrical receptacle portions of the apparatus;

DETAILED DESCRIPTION OF THE DRAWINGS

Figure 1:
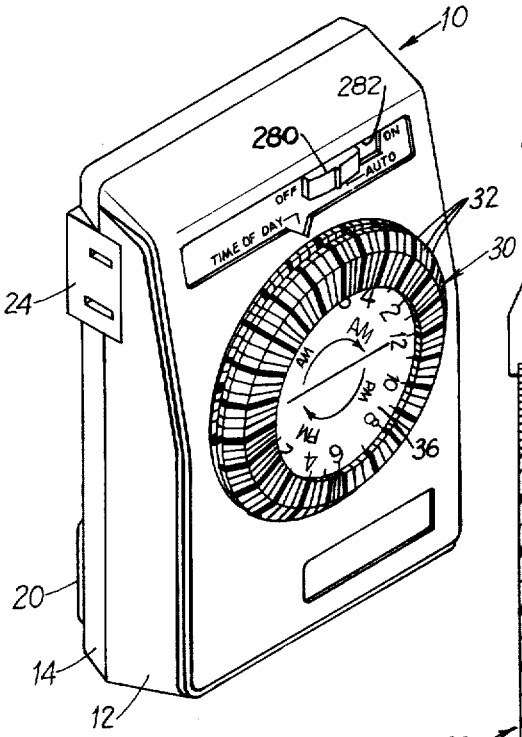
FIG. 1 is a perspective view of the timing and switching apparatus in which the present invention is used.
Figure 3:
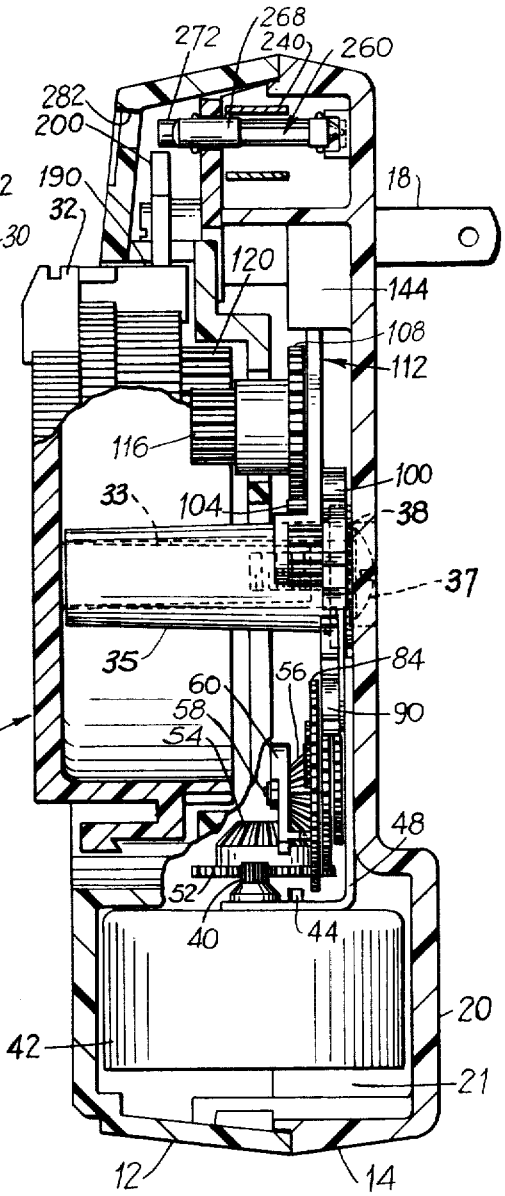
FIG. 3 is a side sectional view taken at section 3—3 of FIG. 2.
Figure 2:
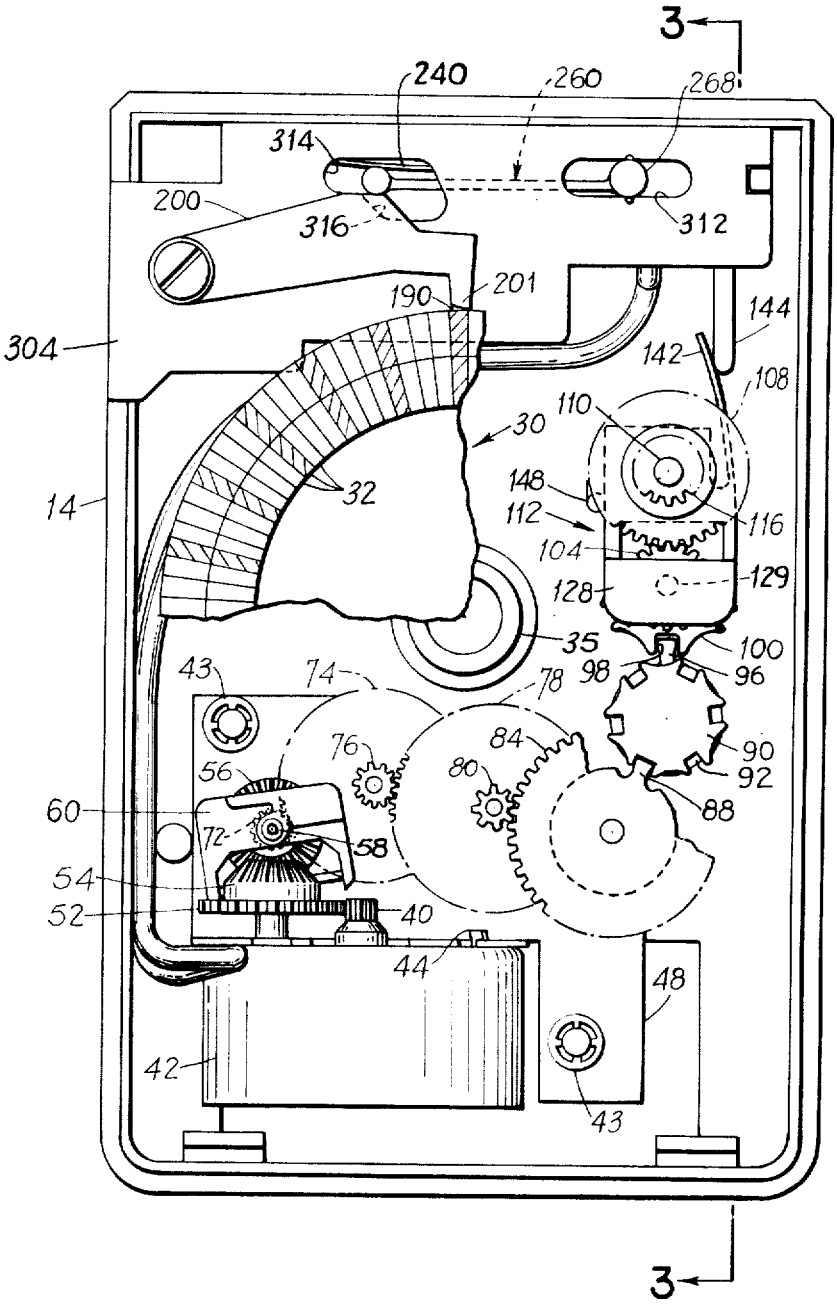
FIG. 2 is a plan view of the apparatus with the top cover of the case removed and with the time setting dial only partially shown in order to better illustrate the internal mechanisms of the apparatus.

Referring to FIGS. 1–3, the lamp and appliance timing apparatus of this invention is comprised of a plastic case 10 formed of front and back case halves 12 and 14. As seen in FIG. 3, electrical connector prongs 18 extend through the back case half 14. Prongs 18 are insertable directly into an electrical power receptacle in a wall of a home or office, for example. An outwardly extending portion 20 at the bottom region of back case half 14 contacts the surface of the wall to maintain the case in substantially a vertical attitude and parallel to the wall surface.

A female receptacle 24, FIG. 1, is located at the upper left side of the timer case. The male electrical plug of the lamp or appliance whose operation is to be controlled will be plugged into receptacle 24.

A rotatable time setting dial 30 is located in a recess molded in front cover half 12. As best illustrated in FIG. 3, time setting dial 30 is comprised of an integrally molded axial shaft 33 that is rotatably supported in a hollow shaft 35 that is an integrally molded part of back case half 14. Removable fastening means such as a screw and washer 37, 38 are received in back case half 14. Screw 37 is threaded into the end of axial shaft 33 of dial 30 and is fixedly held therein. The washer is larger in diameter than the hollow portion of shaft 35 and allows screw 37 to rotate thereon.

As will be explained in more detail below, dial 30 is comprised of a plurality of setting pins 32 that are circumferentially disposed about a centrally positioned time-of-day indicator 36 that has at least some of the numerals of a 24 hour day thereon. In this example, it is assumed that dial 30 makes one revolution in 24 hours of operation and that there are 96 setting pins 32. Consequently, each one of the setting pins corresponds to a 15 minute time period. As will be explained, when the apparatus is in the automatic (AUTO) timing mode of operation, a pin 32 in its innermost position causes the internal switch to be open, and when a setting pin 32 is in its outermost position it causes the internal switch to be closed.

Time setting dial 30 is coupled through a speed reducing gear train, FIGS. 2 and 3, to the output pinion 40 of a synchronous electrical motor 42. The gears in the gear train preferably are molded from a suitable plastic material. Motor 42 is secured by punched out tabs 44, or other suitable means, to an angle bracket 48 that is secured by lock washers to studs (not shown) that are molded on the wall of back case half 14. Motor 42 occupies substantially the entire interior space between the front and back walls of case halves 12 and 14. This is made possible by the recess 21 that is formed in back case 14 by outwardly extending portion 20.

Figure 4:
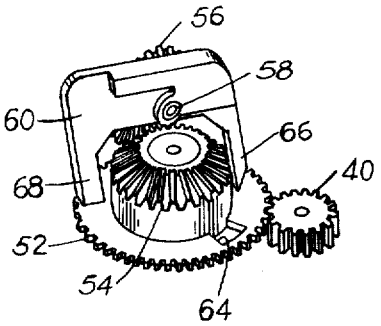
FIG. 4 is a perspective view showing only the directional stop mechanism that permits the synchronous motor to continuously rotate in only one direction.

Output pinion 40 of synchronous motor 42 is in engagement with driven gear 52, FIGS. 3 and 4, that rotates about an axial pin that is secured to angle bracket 48. Driven gear 52 is molded from a plastic material and is integral and coaxial with bevel gear 54. A second bevel gear 56 is in mesh with bevel gear 54 and rotates on axial pin 58 that is supported on the vertical portion of bracket 48.

A rigid directional stop member 60 having the general shape of an inverted letter U is mounted on bevel gear 56. Directional stop member 60 frictionally engages bevel gear 56 with a predetermined amount of friction so as to rock clockwise when gear 56 turns clockwise, and rock counterclockwise when bevel gear 56 turns counterclockwise. The initial direction of rotation of bevel gear 56 is determined by the initial direction of rotation of synchronous motor 42. As is known, synchronous motor 42 may start rotating in either direction when it is first energized. Directional stop member 60 functions to assure that motor pinion 40 will continuously turn only in the desired direction for operating time dial 30. Directional stop member 60 functions as follows.

In FIG. 4, an aperture 64 extends through the side of gear 52 at, or adjacent, the base of bevel gear 54. The right leg 66 of directional stop member 60 terminates in a pointed end that is adapted to freely fit within aperture 64 in gear 52. The left leg 68 of directional stop member 60 is shorter than the right leg and extends radially farther out from axial pin 58 than the right leg does. The bottom end of left leg 68 is blunt.

Should pinion 40 rotate in the undesired clockwise direction, gear 52 and bevel gear 54 will rotate counterclockwise, FIG. 4. Driven bevel gear 56 rotates clockwise. The frictional engagement of directional stop member 60 with rotating bevel gear 56 causes stop member 60 to rock in a clockwise direction until the pointed end of right leg 66 strikes the top surface of rotating gear 52. When aperture 64 in rotating gear 52 comes into registration with the pointed end of leg 66, that end will be forced down into the aperture 64 and will block further counterclockwise rotation of gear 52, i.e., clockwise rotation of pinion 40. On the other hand, when motor 42, rotates pinion 40 in the counterclockwise direction, gear 52 and bevel gear 54 rotate in the clockwise direction. Driven bevel gear 56 rotates in the counterclockwise direction and causes directional stop member 60 to rock counterclockwise. The blunt bottom end of left leg 68 of the stop member contacts the top surface of gear 52. This blunt end is radially beyond aperture 64. Consequently, end 68 merely slides on the top surface of gear 52 and motor 42 continues to rotate. Gear 52 and directional stop member 60 are molded from a plastic material that has a low coefficient of friction so that, together with the predetermined frictional engagement of stop member 60 and bevel gear 56, motor 42 is not significantly loaded when left leg 68 of stop member 60 continuously slides on the top surface of gear 52. Alternatively, a limit stop may be provided to hold end 68 off of gear 52 when member 60 rotates counterclockwise.

A pinion gear 72, FIG. 2, is molded intergrally with driven bevel gear 56 and drives flat gear 74 and its integrally molded pinion 76 in a clockwise direction, looking at FIG. 2. This motion is transmitted through gears 78 and 80 to rotate flat gear 84 in the clockwise direction. Gear 84 has molded integrally therewith a Geneva drive tooth 88 for driving a Geneva follower gear 90 that has six radial tooth receiving slots 92. Therefore, Geneva follower gear 90 makes one complete revolution every six revolutions of gear 84.

Geneva follower gear 90 has integrally molded therewith, on a different level, a second Geneva drive tooth 96 that successively engages the six radial slots 98 of a second Geneva follower gear 100.

Figure 5:
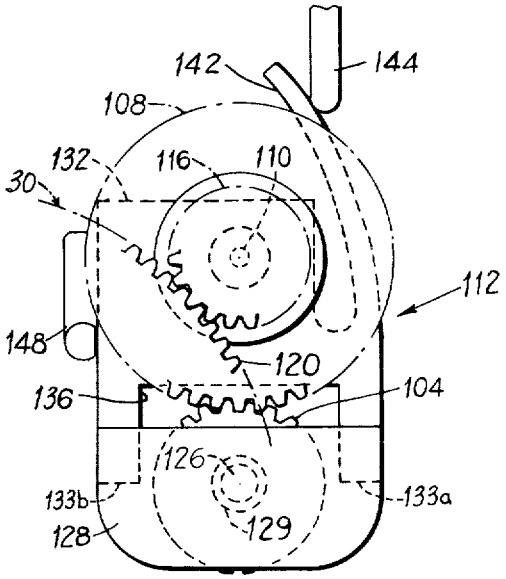
FIG. 5 illustrates in detail a portion of the gear train and the mechanism that allows the time dial on the front of the case to be rotated only in one direction.

A pinion gear 104 is molded integrally with second Geneva gear 100 and rotates therewith. Pinion gear 104 drives a flat gear 108 that is rotatably mounted on an axle pin 110 of a frame member 112, FIGS. 5 and 6. Frame 112 is part of a one-way directional rotation mechanism that will be described below. Pinion gear 116 is molded integrally with, and is positioned in front of, flat gear 108. As seen in FIGS. 3 and 5, pinion 116 meshes with the teeth of gear 120 that is molded integrally with the body of time dial 30.

Before proceeding to describe how time dial 30 and the switch actuating mechanism of this invention cooperate to open and close the switch contacts that are located at the top of the case, it first will be explained how the above mentioned one-way directional rotation mechanism permits time dial 30 to be turned only in a clockwise direction by a person who is setting the dial for the desired ON-OFF times.

Figure 6:
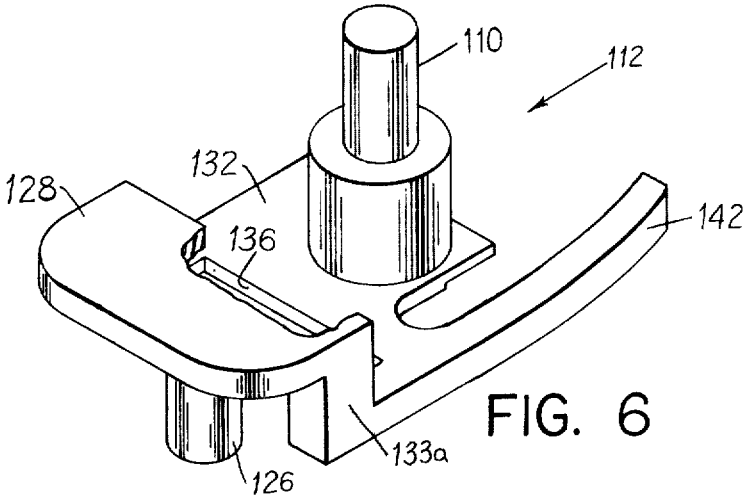
FIG. 6 is a perspective view of the frame member that is illustrated in plan view in FIG. 5.

Referring in particular to FIGS. 2, 5 and 6, frame member 112 is a unitary member of molded plastic and has an axial pivot pin 126 that extends to the rear from a front bottom plate 128. Bottom plate 128 extends outwardly from, and is parallel to, the main plate 132. Arms 133*a* and 133*b* join the two plates in an integral unit. A void space 136 exists between arms 133*a* and 133*b*.

Axial pin 110 is molded integrally with main plate 130 and extends forwardly therefrom. As seen in FIG. 5, flat gear 108 that is rotatably mounted on axial pin 110 meshes with pinion 104 in the void space 136. Geneva gear 100 and its integrally molded pinion 104 are rotatably mounted on back case half 14 by a hollow axial pin 129. Axial pivot pin 126 that extends to the rear from bottom plate 128 of frame 112 is received in hollow axial pin 129 so that the entire frame 112 is rotatable about hollow pin 129, and consequently, is rotatable about pinion 104.

Frame 112 includes a leaf spring 142 on its upper right side. Frame 112 is molded of a plastic material that provides an inherent resiliency for leaf spring 142. A spring stop member 144 extends upwardly from the wall of back case half 14 and retains leaf spring 142 in the position illustrated in FIGS. 2 and 5. A frame stop member 148 also extends upwardly from the wall of back case half 14 and is in contact with the left side of frame 112. Because of frame stop member 148, frame 112 is prevented from rotating counterclockwise about hollow axial pin 129. Frame member 112 may rotate clockwise at a small angle, however, when leaf spring 142 bends in response to a clockwise force being applied to frame 112.

The one-way operation of time dial 30 is best understood by referring to FIGS. 5 and 7. When time dial 30 is manually rotated in the clockwise direction, as it will be during setting, for example, the engagement of gear 120 on time dial 30 with pinion 116 causes a force to be transmitted to pinion 116 that acts to the right, see arrow 152, FIG. 7. This force is transmitted through pin 110 to frame 112. Leaf spring 142 bends or bows in response to this force and allows frame 112 to pivot about its axial pin 126 that is pivotally supported in hollow axial pin 129. When frame 112 has pivoted a sufficient distance, the teeth of gear 120 on time dial 30 will slide past the teeth of stationary pinion 116, thus allowing time dial 30 to rotate. In this manner, time dial 30 may be rotated in the clockwise direction to any desired time setting.

On the other hand, if it is attempted to rotate time dial 30 in the counterclockwise direction, the engagement of the teeth of gear 120 with the teeth of pinion 116 transmits a force to pinion 116 which tends to pivot frame 112 in a counterclockwise direction. This is evident from FIG. 5 wherein it is seen that the engagement between gear 120 and pinion 116 is to the left of a vertical line through the pivot axis (axial pin 126) of frame 112. However, fixed frame stop 148 is against the left side of frame 112 and will not allow it to pivot. Because pinion 116 will not rotate, gear 120 and pinion 116 remain engaged and time dial 30 is prevented from rotating in the counterclockwise direction. Of course, this explanation contemplates only reasonable force being applied to time dial 30 and does not hold if excessive and abusive force is applied.

Setting pins 32 are attached to the periphery of time dial 30 in a manner best illustrated in FIGS. 8 and 9. A peripheral rim 160 extends completely around setting dial 30 and is attached to the main body thereof by means of a web portion 162. Desirably, the time dial assembly that includes rim 160, web 162 and the main body portion 163 is molded as an integral rigid unit from a suitable plastic material. Sets of radially aligned grooves are molded into the rim of the outer edge of the body portion 163 in order to slidably receive the 96 setting pins 32. As seen in FIG. 9, each set of grooves on rim 160 has front and rear grooves 166 and 168. The front edge 170 of groove 168 is inclined, as will be described in more detail below.

A circumferential recess 172 extends between the bottom of rim 160 and the outer edge of the main body portion 163 of dial 30. A front groove 174 is on the periphery of the main body portion 163 of dial 30. The right edge of the dial includes circular gear 120 that meshes with the teeth of pinion 116 which is at the end of the gear train, see FIG. 3.

All setting pins 32 have the same shape and each setting pin is slidably retained in a respective set of the above described radially aligned grooves. As seen in FIG. 8, the setting pin at the top of the drawing is in its innermost (OFF) position and the pin at the bottom of the drawing is in its outermost (ON) position. To pull a setting pin outwardly to its ON position, the user places a fingernail in the notch 180 and pulls the pin out. A dovetail portion at the rear inner corner of the pin slides forward in groove 168 until its inclined surface engages the inclined surface 170 of groove 168. The mating of the two surfaces acts as a stop to prevent complete withdrawal of the pin. A base portion 186 on a pin is received in the front groove 174 on the periphery of the main body 163 of dial 30. Each pin 32 has a finger 188 extending inwardly from base 186. Finger 188 is received within the circumferential recess 172 between rim 160 and groove 174. Each pin has a straight and continuous peripheral edge 190. A small half-rounded projection 192 is located on the inner edge opposite peripheral edge 190, and together with groove 166 and inclined end 170, serves as a detent to retain setting pin 32 in its innermost position (top pin of FIG. 8) and in its outermost position (bottom pin of FIG. 8).

As seen in FIGS. 2 and 3, a switch actuator 200 is pivotally mounted to back case half 14. The free end 201 of the switch actuator is in contact with the peripheral edge 190 of a setting pin 32 when the pin is in its innermost OFF position. However, when one or more setting pins that are pulled to their outermost positions come to the top of dial 30, tip 201 of switch actuator 200 pivots downwardly and contacts the top edges of the ridges between grooves 168.

The electrical contacts and switch blades of the timing apparatus are shown in FIG. 10. On the left side of the drawing, apertures **24*a* and 24*b* of electrical receptacle 24 receive prongs of a male plug on the cord of a lamp or appliance whose operation is to be controlled. Inserted prongs of the plug make contact with the respective formed conductors 206 and 208 that are retained within compartments and passages that are molded in back cover half 14. Conductors 206 and 208 are formed from strips of resilient conductive material, as is conventional in the art. The left end of conductor 206 has a reverse bend that is positioned within a molded recess 207 in back case half 14. The right end of conductor 206 has a right angle bend and its vertical leg 209 is secured to the rear end of one of the male connector prongs 18 and positioned within the wall of a molded rectangular recess 214 in back case half 14. An insulated wire conductor 216 is electrically connected to an intermediate region of formed conductor 206. Wire 216 provides a continuous connection from male prong 18 to synchronous motor 42 at the bottom of case 10, see FIGS. 2 and 3**.

The left end of the other formed conductor 208 of receptacle 24 has a reverse bend that is positioned within a molded recess 219 in back case half 14. The right angle bend and the vertical leg 220 at the right end of conductor 208 is securely captured in a slot formed between upstanding molded partitions 221 and 222 on back case half 14. A contact button 224 is secured to conductor 208.

The second male prong **18*a* is securely wedged in a molded recess 230 in back case half 14. The left end 232 of a movable contact blade 240 is secured to prong 18*a* and positioned within the wall of molded recess 230. Blade 240 is securely held against two pairs of molded support ridges 242 and 244 and the vertical arm 245 on the right of FIG. 10 is supported against a molded support partition 246. Contact blade 240 then makes an abrupt bend and is cantilevered to the left. A contact button 226 is secured to the left end of contact blade 240. Contact blade 240 is made of a resilient conductive material and is normally biased downwardly to the position illustrated in FIG. 10 to maintain contact buttons 224 and 226** in physical and electrical contact.

A second insulated wire conductor 248 is electrically connected to contact blade 240 at a region between support ridges 242 and 244. Wire 248 is the second conductor to synchronous motor 42, FIGS. 2 and 3. It is seen that when prongs 18 and 18a of the timer apparatus are plugged into a wall receptacle, wires 216 and 248 are continuously energized, irrespective of the position of movable contact blade 240. Consequently, wires 216 and 248 continuously energize synchronous motor 42 without regard to the switch means of the apparatus.

In FIG. 10 it is seen how the ON-OFF operation of a lamp or appliance that is plugged into a receptacle 24 is controlled. When the apparatus of this invention is plugged into a wall receptacle that supplies 120 volt, 50 or 60 cycle a.c. power, for example, prongs 18 and 18a both will be energized. Formed conductor 206 is directly in contact with prong 18, and because contact buttons 224 and 226 are closed, formed contact 208 is connected to prong **18*a*. Consequently, an electrical plug inserted into receptacles 24*a* and 24*b* will be connected to prongs 18 and 18*a* and the lamp or appliance will be energized. When movable contact arm 240 is raised to separate contact buttons 224 and 226, the energizing circuit to receptacle 24 is broken and the lamp or appliance connected thereto will be turned off. The means for controlling the operation of movable contact blade 240** now will be explained.

Figure 11:
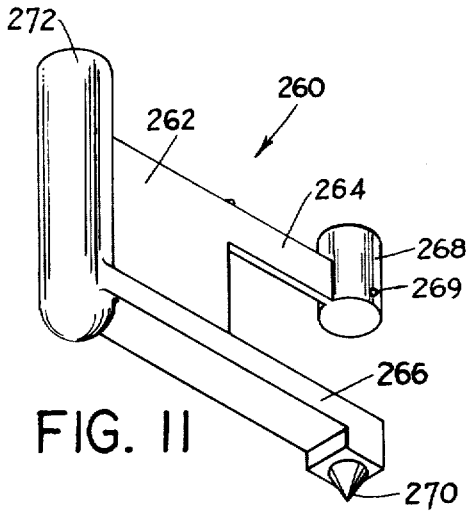
FIG. 11 is a perspective view of a push lever that is controlled by the time dial to open and close the electrical switching means illustrated in FIG. 10.

As seen in FIG. 10, a contact blade push lever 260 is positioned below movable contact blade 240 within a recessed region bounded by molded partitions in back case half 14. Push lever 260 is shown in detail in FIG. 11 and is comprised of a central body portion 262 that has a rigid upper arm 264 and a flexible lower arm 266 extending laterally to the right. A circular post 268 extends upwardly from the end of rigid upper arm 264. A pointed detent 270 is located on the bottom of the free end of flexible arm 266. A push rod 272 extends upwardly from the left edge of body portion 262.

As best seen in FIG. 10, a series of three spaced and parallel V-shaped indents 273*a*, 273*b*, and 273*c* are molded into the wall of back case half 14. Push lever 260 is positioned below movable contact blade 240 with its pointed detent 270 selectively in registration with one of the V-shaped indents 273*a*, 273*b* or 273*c*. As seen in FIG. 1, a selection button 280 is attached to the outer end of circular post 268 and is adapted to slide within a slot 282 that extends through front case half 12.

As will now be explained, selection button 280 controls the mode of operation of the internal switch of this apparatus. When selection button 280 is in its extreme right position (ON) the internal switch is continuously ON irrespective of the settings of setting pins 32 on time dial 30. When selection button 280 is in its extreme left position (OFF), the internal switch is continuously OFF irrespective of the settings of setting pins 32 on dial 30. When selection button 280 is in its center position (AUTO), the opening and closing of the internal switch is controlled by the positions of setting pins 32 on time dial 30.

Figure 12:
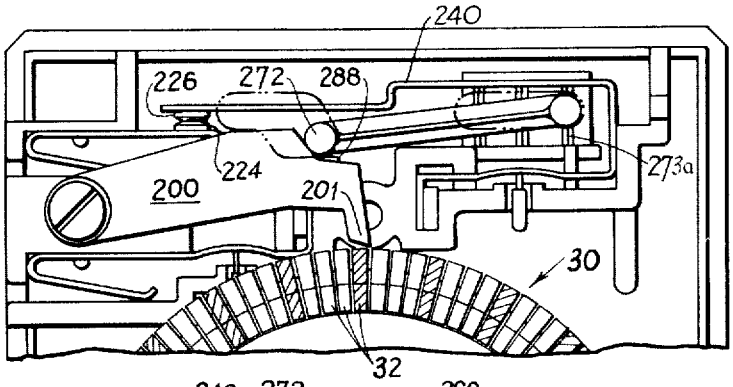
FIGS. 12–15 are partial plan views that show the time setting dial, the switch actuator, the push lever of FIG. 11, and the electrical switching means of FIG. 10 in their various positions during different modes of operation of the apparatus of this invention.

These operations are accomplished as follows. In FIGS. 10 and 12, when selection button 280 is in its extreme right position, the pointed detent 270 on push lever 260 is releasably retained within the V-shaped indent 273*a*. At the left end of push lever 260, push rod 272 is resting on the horizontal portion 288 of the molded partition 290 on back case half 14. As illustrated in FIG. 12, switch actuator 200 is in its uppermost position as it will be when its tip 201 is on the peripheral edge 190 of a setting pin 32. Even though switch actuator 200 is in its uppermost position, it will not raise push rod 272 sufficiently high to engage contact blade 240. Consequently, push lever 260 has no effect whatsoever to change the closed contacts condition (ON) of the internal switch.

Figure 13:
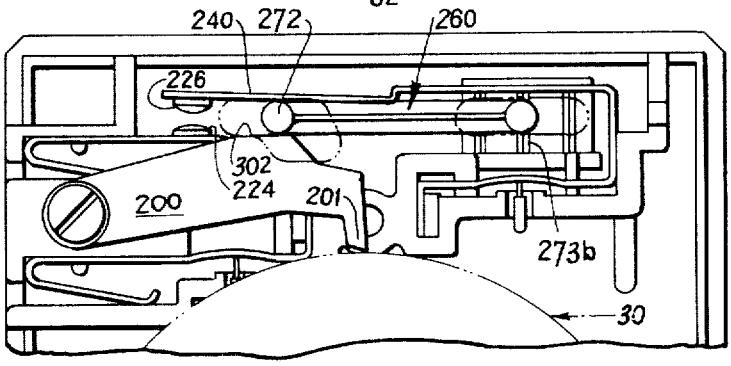

When selection button 280 is in its center (AUTO) position, pointed detent 270 on the bottom of push lever 260 is releasably engaged with the middle V-shaped indent 273*b*, see FIG. 13. In this position, the push rod 272 at the left end of push lever 260 is located on the horizontal portion 288 of partition 290 and is at the bottom of the upwardly inclined ramp 292. In the position illustrated in FIG. 13, the push button 32 immediately below switch actuator 200 is in its innermost (OFF) position and the bottom tip 201 of switch actuator 200 is riding on the peripheral edge 190 of the setting pin. The surface 302 on the top edge of switch actuator 200 engages push rod 272 and urges it upwardly into contact with switch blade 240 so as to separate contact buttons 224 and 226.

Figure 14:
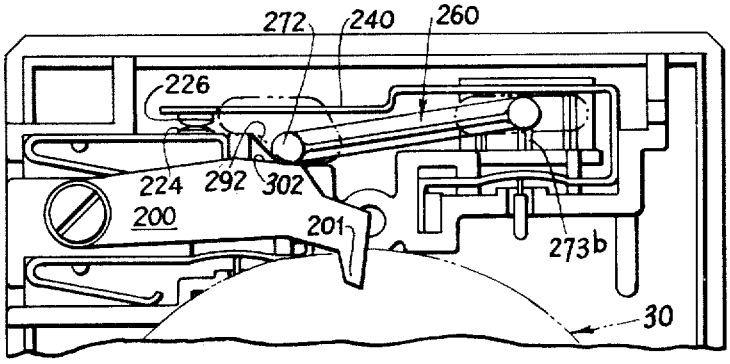

When a setting pin immediately below tip 201 of switch actuator 200 is pulled outwardly to its ON position when push lever 260 is in the AUTO position, FIG. 14, tip 201 of actuator 200 falls down below the peripheral edge 190 of setting pin 302 so that the edge 302 on switch actuator 200 falls out of contact with push rod 272 of push lever 260. Push rod 272 therefore rests on the horizontal surface 288 of partition 290 and is out of contact with switch blade 240. Contact buttons 224 and 226 therefore remain in contact and the internal switch is ON.

Figure 15:
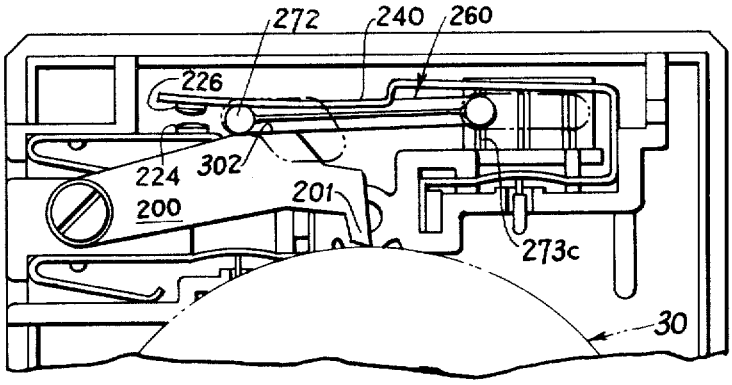

When selection button 280 is in its extreme left position, pointed detent 270 of push lever 260 is releasably engaged in V-shaped indent 273*c*, FIG. 15, and push rod 272 on the left end of push lever 260 has been pushed up the ramp 292 of partition 290. Push rod 272 thus is in continuous engagement with contact blade 240 to urge it upwardly and maintain contact buttons 224 and 226 in their open positions. Push rod 272 is completely out of contact with switch actuator 200 even though the actuator is in its uppermost position. The switch therefore remains OFF irrespective of the settings of setting pins 32 on time dial 30.

As an example of the setting of time dial 30 and the resultant operation of the apparatus of this invention, assume that it is desired to turn on a lamp at 7:00 o'clock p.m. and turn it off again at 11:00 o'clock p.m. Assuming further that all setting pins 32 are in their innermost positions as illustrated in FIG. 1. Using the time of day indicator 36 on time dial 30, all setting pins between the 7:00 o'clock p.m. position and the 11:00 o'clock position are pulled out to their outermost positions. All other setting pins remain in their innermost positions. Selection button 280 at the top right corner of case 10 is placed in its center AUTO position. Time dial 30 then is rotated in the clockwise direction until the actual time of day as indicated by time of day indicator 36 is under the V-shaped notch that is molded into case 10 immediately above dial 30. Prongs 18 and 18*a* on the back of case 10 then are plugged into a wall receptacle and the plug of the lamp is plugged into receptacle 24 on the side of case 10.

Until 7:00 o'clock p.m. arrives, the positions of setting pins 32, switch actuator 200, push lever 260, contact blade 240, and contacts 224 and 226 are as illustrated in FIG. 13 wherein contacts 224 and 226 are open. When 7:00 o'clock p.m. arrives, bottom tip 201 of switch actuator 200 no longer will engage setting pins 32 since the pins are pulled to their outermost positions. Consequently, switch actuator 200 falls to the position illustrated in FIG. 14 wherein push rod 272 is out of engagement with contact blade 240 and contacts 224 and 226 are closed. Receptacle 24 therefore is energized and the lamp is lit. This condition remains until time dial 30 rotates to the position where 11:00 o'clock p.m. is under the time of day indication on case 10. Because the setting pins now are at their innermost positions, switch actuator 200 will be raised to the periphery of the setting pins 32, FIG. 13, and will push push rod 272 up against contact blade 240 and separate contacts 224 and 226.

The example just given is a simple example of the AUTO mode of operation of the timer apparatus. Each one of the setting pins 32 may be placed in its innermost or outermost position so that a multitude of setting combinations may be selected. Because each setting pin corresponds to a 15 minute time period, continuous ON or OFF periods are formed by having the appropriate number of adjacent pins at the proper position. Of course, a fewer or greater number of pins may be provided if desired.

It is seen from the drawings that the timer is relatively easy to assemble, and is easy to take apart for servicing, if necessary. In assembling the apparatus, the gear train and motor 42 are mounted in back case half 14, and the electrical prongs and conductors are inserted and retained by friction fit in the positions illustrated in FIG. 10. A thin, rigid, plastic switch cover 304, FIG. 2, is secured to the top portion of back case half 14 to enclose the electrical conductors that are illustrated in FIG. 10. Cover 304 includes an elongated aperture 312 on its right side to permit post 268 to pass therethrough. Cover 304 also includes a second aperture 314 that is shaped to serve as a cam to guide push rod 272. For example, cam 314 includes a ramp 316 that causes push rod 272 to be raised up as it is pushed to the left. Cam aperture 314 has enough vertical height to permit push rod 272 to raise and fall in the manner described in connection with FIGS. 12–15.

Switch actuator 200 is pivotally attached to cover 304 as by staking or riveting. If desired, the stake or rivet 320 may be in the form of an eccentric that may be rotated to move the free end 201 of switch actuator 200 slightly to one side or the other, thereby providing an adjustment means to assure that the engagement between switch actuator 200 and push rod 272 is as required to achieve the desired making and breaking of contacts 224 and 226. Additionally, the eccentric permits timing adjustments by changing the location of end 201 relative to the pins on dial 30.

Front case half 12 then is placed over back case half 14, FIG. 3, and a screw 21 is screwed into post 23 that is molded on back case half 14. The molded axial shaft 33 on dial 30 then is inserted into hollow shaft 35 that is molded on back case half 14. Screw and washer 37, 38 then are affixed as illustrated in FIG. 3 to hold time dial rotatably affixed to case 10. The case may be taken apart by removing screw 37 and taking time dial 30 away from the case 10. Screw 21 now is accessible and it may be removed to allow the two case halves to be separated.

From the above description it is seen that switch actuation means of this invention is simple and yet reliable to control the opening and closing of switch contacts 224 and 226.

In its broader aspects, this invention is not limited to the specific embodiment illustrated and described. Various changes and modifications may be made without departing from the inventive principles herein disclosed.

What is claimed is:

1. Timing apparatus for controlling the energization of an electrical plug receptacle into which the cord of a lamp or appliance, or the like, may be plugged, comprising a case having front and back walls, an electrical plug receptacle adapted to receive the prongs of an electrical plug, electrical switch means within said case having only one movable contact blade that may be selectively moved to open and close contacts of the switch means, said contact blade normally spring biasing said contacts to their closed positions, means for connecting said switch means to a source of electrical power, electrical conductor means connecting said switch means to said plug receptacle for energizing the plug receptacle when the switch means is closed and for deenergizing the plug receptacle when the switch means is open, a time dial mounted on said case for rotation relative to said case, an electrical motor mounted in said case, means for energizing said motor, gear train means coupling said motor to said time dial to rotate said time dial as a function to the rotation of said motor, a plurality of time setting pins slidably mounted on the periphery of the time dial, each pin being slidable between an inner and an outer position, said inner and outer positions being along a path that is parallel to the axis of rotation of the time dial, said setting pins having peripheral edges that comprise the outermost periphery of the time dial, a switch actuator pivotally mounted for rotation about an axis that is parallel to, and fixed with respect to, the axis of rotation of said time dial, said switch actuator having a free end that contacts said peripheral edges of the setting pins at an actuation position when the setting pins are in their inner positions but being out of contact with the peripheral edges of the pins when the setting pins are in their outer positions, said free end of the switch actuator having such an extent relative to the circumference of the time dial with pins thereon that adjacent pins in their inner positions on the dial will continuously support said free end of the actuator as the adjacent pins pass the actuation position but a setting pin in its outer position that is between two pins in their inner positions will allow the actuator to pivot below the peripheral edges of the two inner pins and into the space therebetween, push rod means for engaging said movable contact blade of the switch means, said switch actuator urging said push rod means into engagement with said contact blade to move the blade to open the contacts of the switch means only when the free end of the switch actuator is in contact with the peripheral edge of a setting pin that is in its inner position.

2. The combination claimed in claim 1 wherein, said push rod means is separate from said switch actuator and is independently supported within said case.

3. The combination claimed in claim 2 wherein, said push rod means is slidably supported in said case for movement toward and away from engagement with said switch actuator and said contact blade, detent means associated with said push rod means, means associated with said case and cooperating with said push rod means and said detent means for releasably positioning said push rod means in one of a plurality of positions that selectively places the push rod means into and out of engagement with said contact blade and with said switch actuator when the switch actuator is engaged with a setting pin in its inner position at said actuation position.

4. The combination claimed in claim 3 wherein said means associated with the case for cooperating with the push rod means and said detent means to selectively place the push rod means into and out of engagement with the contact blade and with the switch actuator comprises, an inclined cam surface fixed relative to said case and located in the path of movement of the slidable push rod means as its moves from one end position where it is at the bottom of said cam surface and out of contact with said switch actuator and with the contact blade to an opposite end position where it is at the top of the cam surface and in engagement with the contact blade to open said switch contacts irrespective of the position of said switch actuator, and means in said case cooperating with the detent means for selectively holding the push rod means in either one of said end positions.

5. The combination claimed in claim 4 wherein said means associated with the case for cooperation with the push rod means and with said detent means to selectively place the push rod means into and out of engagement with the contact blade and with the switch actuator further comprises, cam means on said switch actuator pivotable into the path of movement of the push rod means to contact and raise the push rod means when it is at a selectable third position that is intermediate said two end positions and said switch actuator is on a setting pin at the actuation position, said inclined cam means on the switch actuator being out of the path of the slidable push rod means when a setting pin at the actuation position is in its outer position and the free end of the switch actuator is pivoted away from the push rod means.

6. The combination claimed in claim 5 wherein said means for releasably positioning said push rod means in a plurality of positions includes a post attached to and slidable with said push rod means, an elongated aperture in said case for permitting said post to extend through the case to the exterior thereof, whereby a sliding movement imparted to the post from outside the case slides said push rod means within the case.

7. A switch actuation mechanism for use on timing apparatus that includes a switch contact blade that is movable from a first position at which switch contacts are closed to a second position at which said switch contacts are open, and wherein said timing apparatus further includes a time dial that is rotatable about a first axis, said mechanism further including a plurality of time setting pins slidably attached to the periphery of the time dial, each pin being selectively slidable between an inner and an outer position along a path that is both generally parallel to the axis of rotation of the time dial and normal to the surface plane of the time dial, said setting pins having peripheral edges that comprise the outermost periphery of the time dial, a switch actuator pivotally mounted at one end for rotation about a second axis that is fixed and parallel to said first axis, said switch actuator having an opposite free end that contacts said peripheral edges of the setting pins at an actuation position when the setting pins are in their inner positions but being out of contact with said peripheral edges when the pins are in their outer positions, said free end of the switch actuator having such an extent relative to the circumference of the time dial with pins thereon that adjacent pins in their inner positions on the dial will continuously support said free end of the actuator as the adjacent pins pass the actuation position but a setting pin in its outer position that is between two pins in their inner positions will allow the actuator to pivot below the peripheral edges of the two inner pins and into the space therebetween, movable push rod means located between the switch actuator and the contact blade of the switch means and selectively engagable with both, said switch actuator urging said push rod means into engagement with contact blade to move the blade to open the contacts of the switch means only when the free end of the switch actuator is in contact with the peripheral edge of a setting pin that is in its inner position.

8. The switch actuation mechanism claimed in claim 7 wherein, said contact blade normally spring biasing the switch contacts to their closed positions when in its first position and being urged against its spring bias to open the switch contacts when in its second position.

9. The switch actuation mechanism claimed in claim 8 wherein, said push rod means is separate from said switch actuator and is slidably supported for movement toward and away from engagement with said switch actuator, and means for releasably positioning said push rod means in one of a plurality of positions that selectively places the push rod means into and out of engagement with the switch actuator when the switch actuator is engaged with a setting pin in its inner position at the actuation position.

10. The switch actuation mechanism claimed in claim 9 and further including cam means on said switch actuator engagable with the push rod means when the push rod means is moved to a mid position from a first one of two end positions, and only when the switch actuator is on a setting pin at the actuation position.

11. The switch actuation mechanism claimed in claim 10 and further including, inclined cam means fixed relative to said axis of rotation of the switch actuator for raising the push rod means into engagement with the contact blade to open the switch contacts when the push rod means is moved from its mid position to the second one of its end positions, said push rod means being out of engagement with both the switch actuator and the contact blade when in the first one of its end positions, said second end position being nearer the axis of rotation of the switch actuator than the first end position.

* * * * *